US008454055B2

(12) United States Patent
Cheng et al.

(10) Patent No.: US 8,454,055 B2
(45) Date of Patent: Jun. 4, 2013

(54) TRAVEL GUIDE BOOKLET WITH REMOVABLE CARDS

(76) Inventors: Hui Ting Cheng, Sunnyvale, CA (US); Marusia Musacchio, Mexico City (MX)

( * ) Notice: Subject to any disclaimer, the term of this patent is extended or adjusted under 35 U.S.C. 154(b) by 470 days.

(21) Appl. No.: 12/199,673

(22) Filed: Aug. 27, 2008

(65) Prior Publication Data

US 2009/0058071 A1 Mar. 5, 2009

Related U.S. Application Data

(60) Provisional application No. 60/969,089, filed on Aug. 30, 2007.

(51) Int. Cl.
*B42F 21/00* (2006.01)
*B65D 27/00* (2006.01)

(52) U.S. Cl.
USPC ..... 283/38; 283/36; 283/37; 283/42; 283/43; 40/359; 40/360

(58) Field of Classification Search
USPC 283/34, 35, 63.1, 36–38, 41–43; 40/359–360
See application file for complete search history.

(56) References Cited

U.S. PATENT DOCUMENTS

| | | | | | |
|---|---|---|---|---|---|
| 1,319,386 | A * | 10/1919 | Gregory | 283/36 |
| 1,403,622 | A * | 1/1922 | Paulson | 283/36 |
| 3,950,871 | A * | 4/1976 | Rege | 40/492 |
| 5,246,252 | A * | 9/1993 | Gaddis | 283/63.1 |
| 5,918,905 | A | 7/1999 | Wilen | |
| 6,103,332 | A * | 8/2000 | McDonald | 283/34 |
| 6,752,427 | B1 | 6/2004 | Wilen | |
| 2005/0235533 | A1 * | 10/2005 | Lemberger | 40/360 |
| 2006/0061082 | A1 * | 3/2006 | Clemente Badillo | 283/63.1 |
| 2006/0220374 | A1 | 10/2006 | Dorn | |

FOREIGN PATENT DOCUMENTS

| | | | |
|---|---|---|---|
| JP | 3011083 | Y | 3/1995 |
| JP | 3024789 | Y | 3/1996 |
| JP | 2000-135069 | A | 5/2000 |
| JP | 2004-330640 | A | 11/2004 |
| KR | 20-271142 | Y | 3/2002 |
| KR | 10-0682628 | B | 2/2007 |

OTHER PUBLICATIONS

Easy Spanish Phrase Book (ESPB) (Published, May 24, 1994) http://www.amazon.com/Easy-Spanish-Phrase-Book-Everyday/dp/0486280861/ref=sr_1_1?ie=UTF8&qid=1338921900&sr=8-1#_.*

International Search Report dated Oct. 31, 2008 for Application No. PCT/US2008/074920, 10 pages.

* cited by examiner

*Primary Examiner* — Dana Ross
*Assistant Examiner* — Kyle Grabowski
(74) *Attorney, Agent, or Firm* — Fliesler Meyer LLP

(57) ABSTRACT

A booklet with removable cards, together with a variety of systems, methods, and applications associated therewith. Embodiments can be incorporated into books, booklets, maps, catalogs, travel guides, schedules, and other printed information and materials. In one embodiment, the booklet comprises a travel guide having a plurality of information cards as pages. Each information card can provide information about a travel destination, language translation, cultural pointers, or other information. The cards are bound using a first ring fastener that can be opened by the reader so that one or more cards can be removed from the booklet, and carried in a wallet, on a second ring fastener, or as a second booklet, distinct from the main booklet.

20 Claims, 23 Drawing Sheets

122

Zhujiajiao 1

朱家角

Leave behind Shanghai's glamour and hectic pace, and escape to this picturesque, laid-back water-town. Willow trees, stone bridges, and houses with beautiful courtyards make the one hour trip to Zhujiajiao a terrific complement to your stay in ever-modernizing Shanghai. Buy the 60rmb entrance ticket to the old town which includes access to all the sights or pay 10rmb to just walk around.

25

124

Zhujiajiao 2

How to get there:

上海体育馆（四号口）

Shanghai Stadium (Gate 4)

Line 4 Shanghai Stadium Map B4

From the Shanghai Stadium, get on Bus # 4 to Zhujiajiao, an hour and a half from the city. Buses run every hour. Try to get an early bus since the last bus back to Shanghai is at 4:30pm.. Ticket price: 12rmb.

26

FIG. 10

128

Bird & Insect Market

鸟虫市场

江阴路(近黄陂北路)

Jiangying Lu (by Huangpi Bei Lu)

6327-2261 9:30 am - 6 pm

Line 1/2 People's Square Map C2

1

FIG. 11

132

Bird & Insect Market (11) (14)

This lively Street will give you a chance to experience traditional Chinese culture.You will be able to witness Shanghainese residents picking all kinds of animals. Crickets are especially popular as Chinese people like to put them in boxes and Listen to them chirp.

Not as flashy as most of the places in Shanghai, but definitely more authentic.

FIG. 12

136

South Beauty

俏江南

延安中路 881 号（近铜仁路）

881 Yan'an Zhong Lu (by Tongren Lu)

51

6247-6682

11 am - 10 pm

Line 1Shanxi Nan Lu

Map B3

FIG. 13

140

South Beauty ($$$) (57) (71)

SICHUAN

Get your tongue numbed with Sichuan's unforget-table pepper! Superb food in a modern and stylish setting.

- 麻酱油麦菜 Lettuce with peanut and sesame
- 江石滚肥牛 Sliced beef in hot oil and stones
- 金牌水煮鱼 Sliced fish in pungent sauce
- 泡椒龙虾仔 Baby lobster with pickled peppers
- 干煸四季豆 Kidney beans with minced pork and bean sprouts

FIG. 14

144

Cloud 9
九重天酒廊

世纪大道 88 号 87 楼(金茂大厦)
88 Shiji Dadao, 87/F (Jinmao Tower)

65

5049-1234

Mon-Fri 6 pm - 1 am
Sat-Sun 11 am - 1 am

Line 2 Lujiazui

Map E2

FIG. 15

146

Cloud 9

18 40

Famous for being the highest bar in the world, Cloud 9 is worth checking out only if you are already in Pudong. The scene is primarily hotel guests and visitors to the Jinmao tower. There is a minimum cover charge of 120rmb which includes one drink. A dress code is enforced so do not show up in your flip-flops.

Perhaps more impressive than the bar itself is the hotel interior, best viewed from the patio lounge on the 56th floor.

FIG. 16

182

Useful Phrases in Chinese

你好！(NI hǎo!) Hello!
再见！(Zài jiàn!) Goodbye!
谢谢！(Xiè xie!) Thank you!
对不起！(Duìbùqi!) Sorry!
我要买！(Woyàomai...) I want to buy...
...多少钱？(...Duǒshǎo qián?) How much is it/a...?
餐巾纸 (Cǎnjin zhi) Napkins
避孕套 (Bì yùntào) Condoms
妇女卫生巾 (Fùnu˘wèisheňgjin) Sanitary napkins
对 (Duì) Yes
不 (Bù) No

98

FIG. 19

184

Food

字

- 米饭 Rice
- 少油 Less oil
- 酱油 Soy sauce
- 无味精 No MSG
- 少盐 Less salt
- 醋 Vinegar
- 酸辣汤 Hot and sour soup
- 红烧茄子 Braised eggplant
- 宫爆鸡丁 Kungpao chicken
- 麻酱豆腐 Mapo tofu

FIG. 20

186

Railway Stations

上海火车站
6317-0481/6317-9090 24hrs
Line 1/3/4 Shanghai Railway Station Map B1

上海南站
5110-5110 24hrs
Line 1/3 Shanghai South Railway Station Map A4
Ticket booking 9510-5105

94a

FIG. 21

210

Moganshan Lu

5 78

Shanghai's own version of New York's Soho, this warehouse district is now home to a new generation of local and foreign artists. Forget about traditional Chinese landscape paintings, Mogashan Lu's galleries will give you a taste of the Contemporary.

Art Scene Warehouse is a good place to start your gallery happing. They usually have interesting installations, sculptures and paintings that are a hit with Shanghai's expat community.

Element Fresh
HEALTHY $$ 63 81

Tired of greasy Chinese? Come here for that fresh healthy salad and smoothie. Great terrace

- 酉戊陆壬叁柒玖拾 Homemade hummus
- 伍肆贰辛戊丙柒 Laffa bread salad
- 戊拾柒捌玖拾 Duck with grilled apple sandwich
- 柒捌玖拾甲丙戊 Cooper's teriyaki salad
- 伍肆壬叁 Soft Japanese tofu

Cotton's

46 63

Set in an old villa. Cotton keeps drawing local residents back. A place to unwind with good mixed drinks after work. Cozy interior with fireplaces for the winter and a great garden in the summer. Avoid any food item here that is not a burger.

Traditional Chinese Clothing

36 86

Mooming Lu is "the mecca" for custom tailored qipaos. Prices range from 600 - 8000rmb.

The most reasonable shops are Jin Ming on No. 136 and Jin Feng Huang on No. 84 where you can get a short-length qipao in 2 days for 600rmb. If you have a fat wallet, head to Jinzhiyuye on No. 98 for a top quality silk and elaborate hand-woven embroidery work. Make sure to bargain in these shops.

Food

- 玖柒 Rice
- 柒捌 Less oil
- 戊捌 Soy sauce
- 丙戊拾 No MSG
- 拾丙 Less salt
- 玖 Vinegar

- 丙戊拾 Hot and sour soup
- 拾戊丙甲 Braised eggplant
- 玖捌柒戊 Kungpao chicken
- 柒捌玖拾 Mapo tofu

FIG. 29

220

Yuyuan Gardens & Bazaar
豫园
福佑路（近丽水路）
Fuyou Lu (by Lishui Lu)
6326-0830
N/A
8:30 am - 4:30pm
Map E3

20

Yuyuan Gardens & Bazaar 48 82

A compulsory stop over! Most of the buildings in this area are recent, with the exception of the tea house in the middle of the pond and the exquisite Yuyuan Gardens. Yuyuan was built during the Ming dynasty and is the jewel of the city. Sit by the traditional rock garden and you will forget that you are in Shanghai! Also check out the nearby Buddhist temple on 29 Chenxiang Lu by Jiaochang Lu, the ticket is 5rmb [9am - 4pm].

Garden entrance fee: 40rmb

New Heights
新视角
中山东一路 7 楼（近广东路）
3 Zhongshan Dong Yi Lu, 7/F (by Guangdong Lu)
6321-0909
Line 2 Nanjing Dong Lu
11 am - 2:30 pm
6 pm - 10 pm
Map E2

48

Antique Market
藏宝楼古董市场
方浜中路 457 号（近河南南路）
457 Fangbang Zhong Lu (by Henan Nan Lu)
N/A
N/A
9 am - 5 pm
Map D3

82

New Heights
Fusion
$$$ 20

The view from the terrace is priceless and amazing at sunset, Don't expect good service but it is the best deal you can get on the Bund

- 香炸鸭肉春卷 Crispy duck spring rolls
- 烤鳕鱼 Roast cod fillet
- 扒澳州西冷牛肉 Grilled Australian sirloin
- 摩洛哥式羊排 Moroccan lamb cutlets
- 扒金枪鱼 Grilled tuna

Antique Market 20 48

Located on one end of the Yuyuan bazzar, this market is a good place to buy all manners of antiques The best time to visit is in the morning when it is at its most bustling. Some of the nicest antiques date back to the Hu era. (Haven't heard of it? Hint hint: Hu Jintao) Watch out for fakes.

FIG. 32

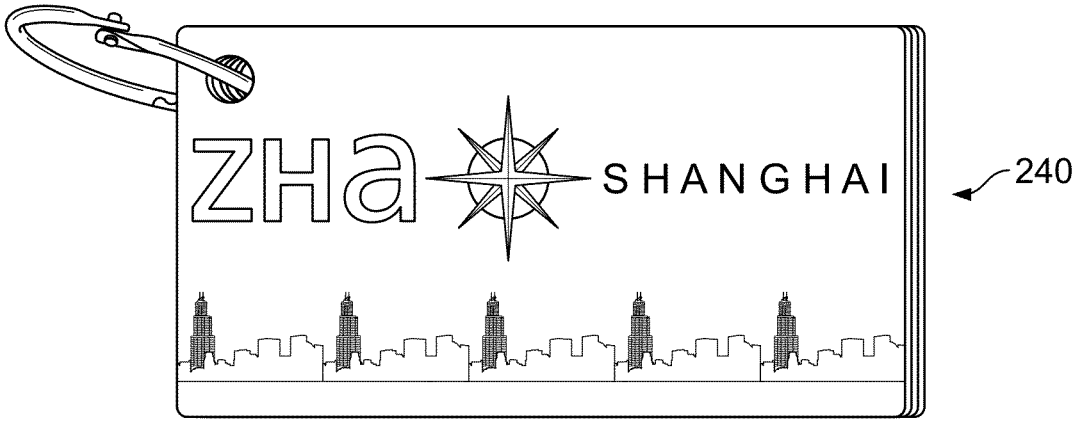
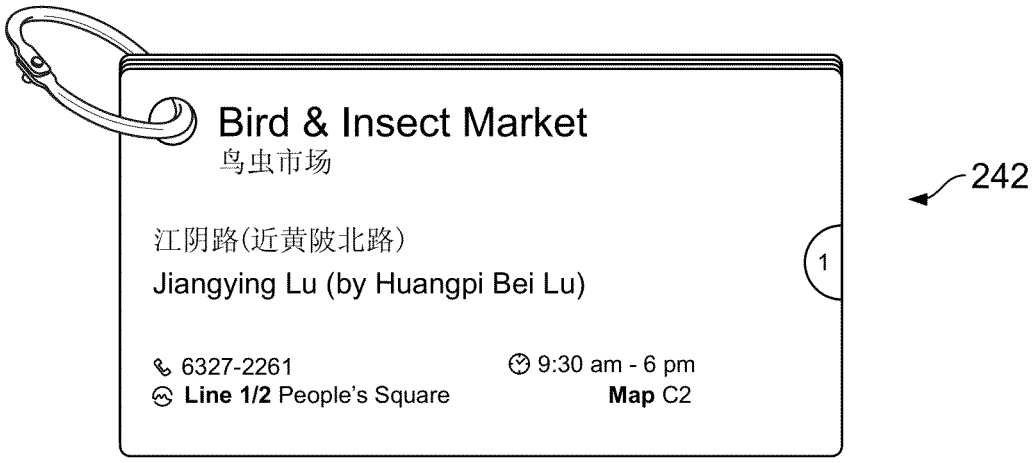
FIG. 34

TRAVEL GUIDE BOOKLET WITH REMOVABLE CARDS

CLAIM OF PRIORITY

This application claims the benefit of priority to U.S. Provisional Patent Application titled "TRAVEL GUIDE BOOKLET WITH REMOVABLE CARDS"; Application No. 60/969,089; filed Aug. 30, 2007, and incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The invention is generally related to books, booklets, maps, catalogs, travel guides, schedules, and other printed information and materials, and particularly to a booklet with removable cards, and to a variety of systems, methods, and applications associated therewith.

BACKGROUND

Printed guide books and booklets are used for a variety of purposes, including travel guides, dictionaries, collectible guides, and other reference books. The vast majority of guide books are published as bound books, using traditional binding techniques. This is acceptable for most purposes since the intent is to provide the reader with a complete set of information. One of the problems however, is that the reader is typically required to then carry the complete book with them, wherever they feel they may need to refer to that book. The reader may typically also have to search an index or a set of content pages to find the particular portion of the book they are interested in at that moment in time. Some people may choose to bookmark or use tabs to mark pages of particular interest, but even then they will have to search through their tabbed and marked pages, overlooking all of the other pages; and of course the addition of bookmarks and tabs adds to the overall size, weight, and bulk of the book.

The problem of book size is particularly acute with regard to travel guides and similar travel or activity-oriented guide books. Many readers like to plan trips in advance, so favor a larger guide book, with a greater variety of listings, and more detailed information about each listing. However, once having made their travel plans and on the road the reader is typically more interested in having information about their planned itinerary, and is unlikely to need the additional information a large guide book provides. The travel publication industry has responded by publishing both larger and more detailed guidebooks that one might read in their hotel, and pocket-sized books that one might carry. One problem with this approach is that there is rarely any consistent overlap between the listings in each of the variety of books, so that readers often end up taking both books along anyway, which simply exacerbates the problem.

SUMMARY

Described herein is a booklet with removable cards, together with a variety of systems, methods, and applications associated therewith. Embodiments of the invention can be incorporated into books, booklets, maps, catalogs, travel guides, schedules, and other printed information and materials. In one embodiment, the booklet comprises a travel guide having a plurality of information cards as pages. Each information card can provide information about a travel destination, language translation, cultural pointers, or other information. The plurality of information cards are bound using a first ring fastener that can be opened by the reader so that one or more cards can be removed from the booklet. The booklet further comprises a second ring fastener. Cards that are removed from the booklet can be placed onto the second ring fastener and carried separately as a second booklet, distinct from the main booklet. In this manner the reader can have a complete set of information when they wish to refer to it, but can carry with them an abbreviated set of pages suitable for a day's sightseeing. Additional features of the booklet and of the cards are described herein.

BRIEF DESCRIPTION OF THE FIGURES

FIG. 10 is another illustration of a booklet in accordance with an embodiment, showing an example page (front and back) of information for a weekend getaway destination (in this instance in English and Chinese).

FIG. 11 is another illustration of a booklet in accordance with an embodiment, showing an example page (front) of information for a local attraction.

FIG. 12 is another illustration of a booklet in accordance with an embodiment, showing an example page (back) of information for a local attraction.

FIG. 13 is another illustration of a booklet in accordance with an embodiment, showing an example page (front) of information for a restaurant.

FIG. 14 is another illustration of a booklet in accordance with an embodiment, showing an example page (back) of information for a restaurant.

FIG. 15 is another illustration of a booklet in accordance with an embodiment, showing an example page (front) of information for an entertainment venue.

FIG. 16 is another illustration of a booklet in accordance with an embodiment, showing an example page (back) of information for an entertainment venue.

FIG. 19 is an illustration of a booklet in accordance with an embodiment, showing the reverse page of translation information.

FIG. 20 is an illustration of a booklet in accordance with an embodiment, showing a page of food-ordering information.

FIG. 21 is an illustration of a booklet in accordance with an embodiment, showing a (front) page of railway information.

FIG. 29 is an illustration of a booklet with removable cards in accordance with an embodiment, showing how individual cards can be used to create a set of cards for a day trip, or an extended trip.

FIG. 32 is an illustration of how individual cards can be used to create a set of cards for a day trip, or an extended trip, wherein the cards can be linked through common symbols and numeric identifiers.

FIG. 34 is an illustration of a booklet in accordance with an embodiment, showing how the ring fasteners can be separated to create two booklets (shown here side-by-side), including a primary booklet and a secondary booklet.

DETAILED DESCRIPTION

Figure 1:
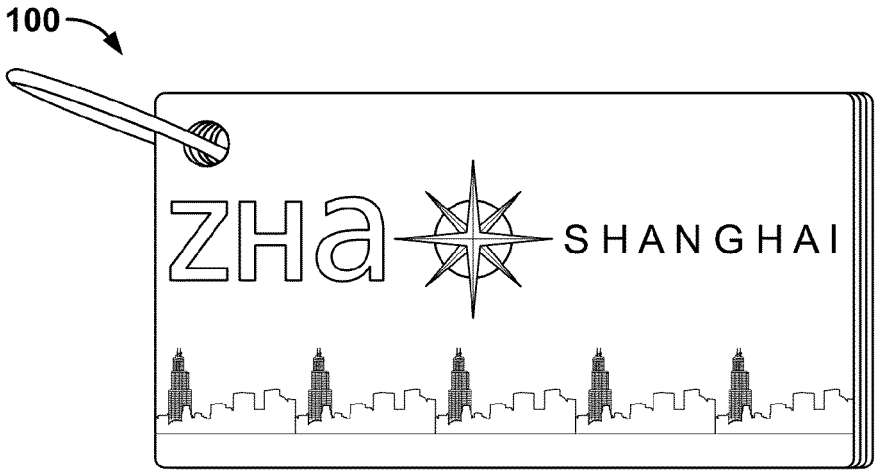
FIG. 1 is an illustration of a booklet (closed) with removable cards in accordance with an embodiment.

Described herein is a booklet with removable cards, together with a variety of systems, methods, and applications associated therewith. Embodiments of the invention can be incorporated into books, booklets, maps, catalogs, travel guides, schedules, and other printed information and materials.

In accordance with an embodiment referred to herein as "Zhao Cards", the booklet provides a way for the reader to focus on travel destinations and deal with other travel-related and everyday tasks, that would be otherwise difficult to get around, or to handle, due to language and cultural barriers. One of the objectives is to provide a solution to travelers or tourists who prefer not to carry a bulky guidebook while traveling. Not only is it light and compact, the booklet provided by "Zhao Cards" is designed to especially address common language barriers that are typical of tourists visiting destinations where the different language is itself a barrier. In many instances the booklet or guide allows the traveler or tourist to get around town, without worrying about not being able to speak the language. It is particularly useful for visitors to a city or region, who want to experience that city or regions just as the locals do.

In accordance with an embodiment, the booklet comprises a travel guide having a plurality of information cards as pages. Each information card can provide information about a travel destination, language translation, cultural pointers, or other information. The plurality of information cards are bound using a first ring fastener that can be opened by the reader so that one or more cards can be removed from the booklet. The booklet further comprises a second ring fastener. Cards that are removed from the booklet can be placed onto the second ring fastener and carried separately as a second booklet, distinct from the main booklet. In this manner the reader can have a complete set of information when they wish to refer to it, but can carry with them an abbreviated set of pages suitable for a day's sightseeing.

Some of the features and advantages of various embodiments can include:

The information on each card can be written by people who live in the city they are writing about, so that each venue can be carefully handpicked and personally visited, for a better local feel and quality of information.

Each group of cards can use a distinct color for each city or region, and can then organize each category within that city or region by gradually changing the color of the card or a symbol, border, or shading of the card.

Removable cards or pages can allow the reader to take only those cards which they need for a daytrip, or for an extended trip.

The second ring fastener can be used as a "day ring" which allows the day traveler to keep selected cards (and optionally a map) in a particular order, for better planning and ordering of the day's activities.

The booklet can be designed to fit in a wallet or purse, and the removable cards can be made to a standard credit card size to fit in a standard wallet. Different kinds of accessories such as matching color pouches, holders, and wallets can be provided for carrying the cards.

The booklet can serve as a language tool, in that both a reader's own language (i.e. the reader's language of choice, for example, English) and the language of the destination city (for example, Chinese, Spanish, Japanese, or another destination language) is written on the cards.

The booklet or guide can be easily and frequently updated, including updating one or several cards as required, so that it is always up-to-date.

Within the booklet, each category can be illustrated by a specific color and indicated by an icon on the back of the card.

All of the cards can be numbered and divided into several categories, such as: Sightseeing, Food, Entertainment & Activities, Shopping, and Other In accordance with an embodiment, the Food section provides several options for ordering, both written in English (or the reader's language of choice) and the language of the city the reader is traveling in. This is especially useful for venues that do not have the menu options provided in English (or in the reader's language of choice).

In accordance with an embodiment, the Shopping section provides an estimate price of how much the reader should pay per item, and provides the reader with suggestions on what unique items to purchase in a particular store.

In accordance with an embodiment, the Other section provides information and words for ordering drinks, common dishes, emergency numbers, and websites for cultural activities and events.

On the back of each card, there are two numbers which represent two recommended venues that are near the area you are in. In general, they are within walking distance, but in some cases, they are just a short-cab ride away A martini glass symbol on some cards of the food section indicates that the venue has a bar.

A bowl of noodles on some cards of the food section indicates that food is served in an entertainment venue.

A map can be included (in a card or fold-out format) that includes all the venues, indicated by the card number.

An online or mobile system can be provided, so that the booklet or individual card information can also be provided online, or using a mobile device, PDA, or cell phone.

Additional features of the booklet and of the cards are described herein.

FIG. 1 is an illustration of a booklet 100 (closed) with removable cards in accordance with an embodiment. As shown in FIG. 1, each booklet can describe a particular city or region, such as in this example the city of Shanghai. Similarly, in accordance with other embodiments each booklet could be used as a guide to describe information related to a particular hobby, or an activity.

Figure 2:
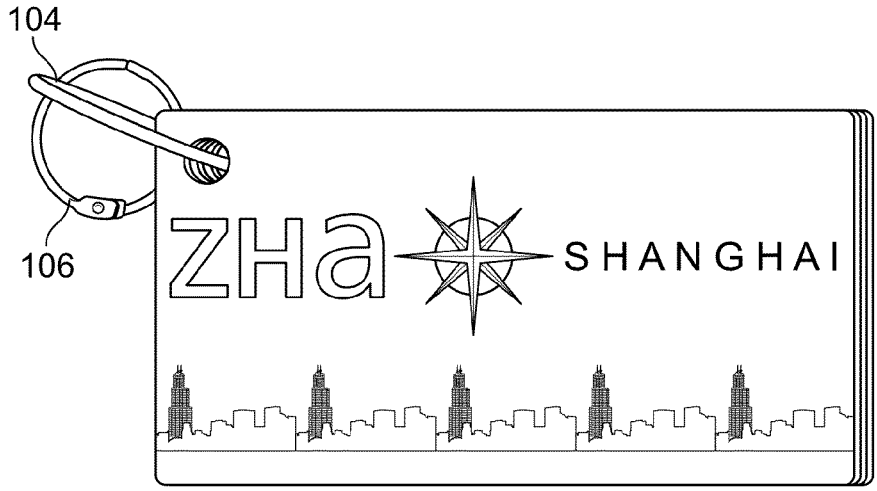
FIG. 2 is another illustration of a booklet (closed) with removable cards in accordance with an embodiment, including a primary ring fastener and a secondary ring fastener.
Figure 3:
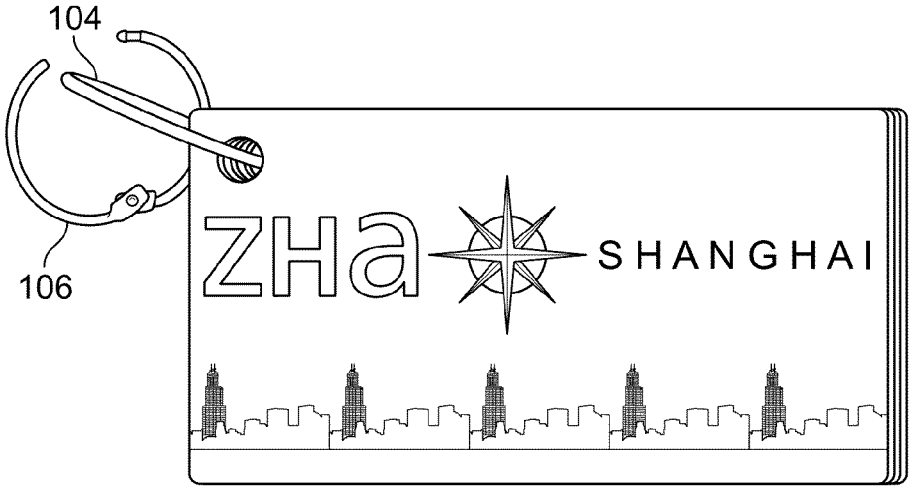
FIG. 3 is another illustration of a booklet (closed) with removable cards in accordance with an embodiment, including a primary ring fastener and a secondary ring fastener.

FIG. 2 is another illustration of a booklet (closed) with removable cards in accordance with an embodiment, including a primary ring fastener 104 and a secondary ring fastener 106. As shown in FIG. 2, in accordance with an embodiment, the primary and secondary ring fasteners are made of a metallic or a steel-like material, and open to allow the rings to be separated. In accordance with other embodiments the fasteners can be made of a different material, such as plastic, and can be formed in a different shape. In accordance with other embodiments, many ring fasteners (i.e. a plurality of the secondary ring fasteners) can be provided, allowing for the creation of multiple booklets. In accordance with other embodiments that do not include a secondary ring fastener, pages can still be removed and kept or carried in the various wallet formats, as described in further detail below FIG. 3 is another illustration of a booklet (closed) with removable cards in accordance with an embodiment, including a primary ring fastener and a secondary ring fastener. As shown in FIG. 3, in accordance with an embodiment, either one or both of the primary and secondary ring fasteners can be opened to allow the rings or fasteners to be separated.

Figure 4:
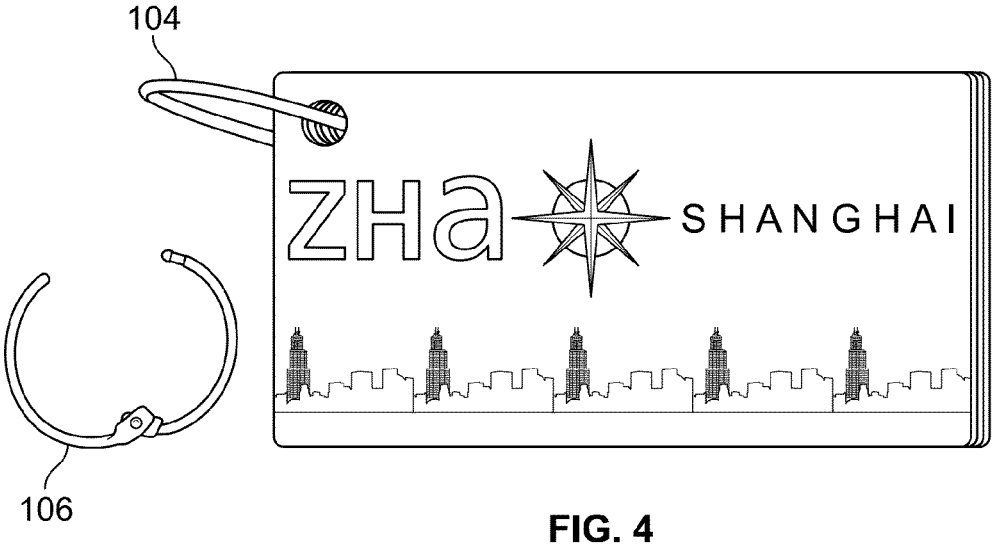
FIG. 4 is another illustration of a booklet (closed) with removable cards in accordance with an embodiment, including a primary ring fastener and a secondary ring fastener.

FIG. 4 is another illustration of a booklet (closed) with removable cards in accordance with an embodiment, including a primary ring fastener and a secondary ring fastener. As shown in FIG. 4, the fasteners can be completely separated and used to create two booklets (or in the case of a plurality of ring fasteners then a plurality of booklets).

Figure 5:
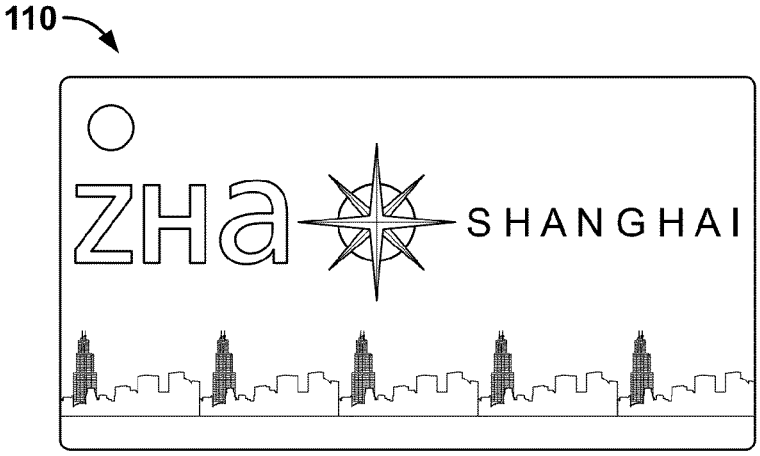
FIG. 5 is an illustration of a booklet cover in accordance with an embodiment, showing an example of how each booklet cover can represent the information for a particular city or region.

FIG. 5 is an illustration of a booklet cover in accordance with an embodiment, showing an example of how each booklet cover can represent the information for a particular city or region. In particular, each city or region can have a particular color scheme associated therewith, or city-specific graphical designs.

Figure 6:
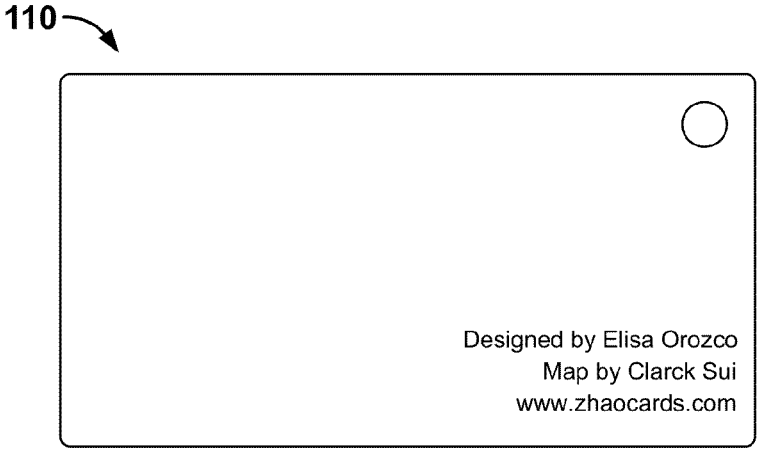
FIG. 6 is an illustration of the back side of a booklet cover in accordance with an embodiment.

FIG. 6 is an illustration of the back side of a booklet cover in accordance with an embodiment. FIGS. 5 and 6 also illustrate that in accordance with an embodiment each of the cards is punched in a corner to provide a hole 110 to insert the ring or fastener through.

Figure 7:
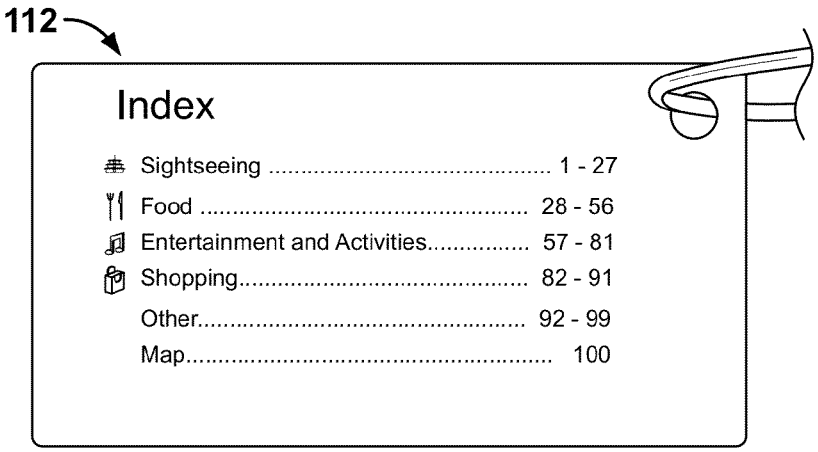
FIG. 7 is another illustration of a booklet in accordance with an embodiment, showing an example of an index page

FIG. 7 is another illustration of a booklet in accordance with an embodiment, showing an example of an index page 112. Each of the various activities for a region, such as sightseeing, food, entertainment and shopping, can be represented by a symbol. Each of the cards that describe the activities can then be marked with an appropriate card number that is unique to that card, together with an appropriate symbol for ease of use in locating and sorting.

Figure 8:
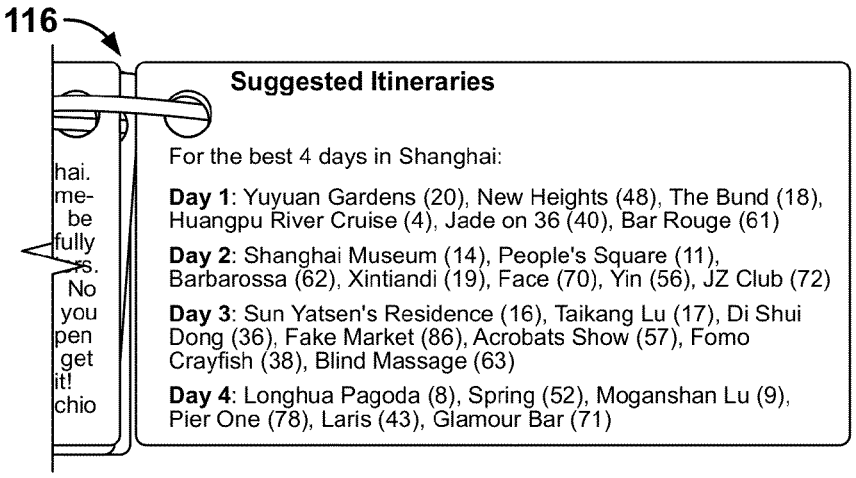
FIG. 8 is another illustration of a booklet in accordance with an embodiment, showing a page of suggested itinerary information for a travel destination, in this instance Shanghai.

FIG. 8 is another illustration of a booklet in accordance with an embodiment, showing a page of suggested itinerary information 116 for a travel destination, in this instance Shanghai. As shown in this example, the card includes a suggested itinerary spanning 4 days, and including several attractions on each day. Each of the named attractions includes a number in parentheses. The number corresponds to the card number for the card that describes that attraction in further detail.

Figure 9:
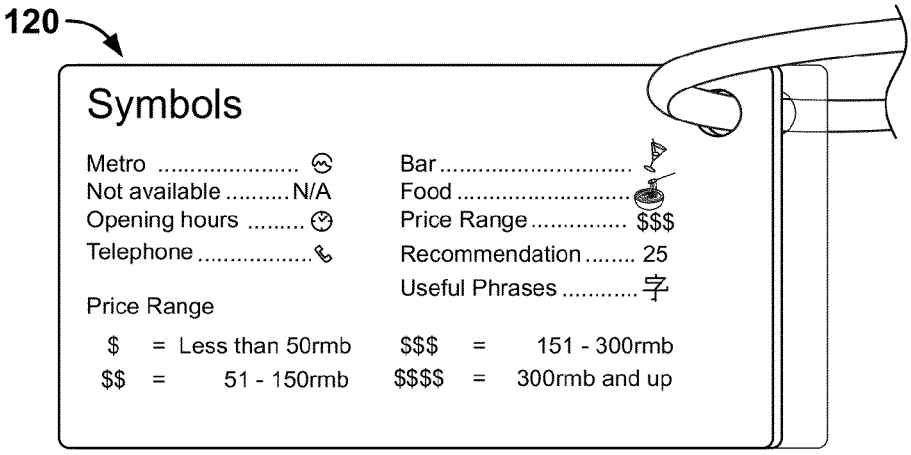
FIG. 9 is another illustration of a booklet in accordance with an embodiment, showing an example of a symbols page.

FIG. 9 is another illustration of a booklet in accordance with an embodiment, showing an example of an symbols page 120. Each card can also include activity symbols, such as nearest metro station, opening hours, drink and food options, price range, and recommendation value. This allows the cards to be marked with the appropriate symbol for ease of use in picking preferred cards for a day's activities.

FIG. 10 is another illustration of a booklet in accordance with an embodiment, showing an example page (front 122 and back 124) of information for a weekend getaway destination (in this instance in English and Chinese). The card includes information about how to get there, and other useful information, printed, for example, both in English and in Chinese. This allows the card to be, for example, handed to a taxicab driver or a local person, if the reader needs assistance. The reader does not need to know the local language, since they can read the card in, say, their own English language, and then hand the card to the local-speaking recipient so that the local-speaking recipient can read the card in their own, local language.

FIG. 11 is another illustration of a booklet in accordance with an embodiment, showing an example page (front) of information for a local attraction 128.

FIG. 12 is another illustration of a booklet in accordance with an embodiment, showing an example page (back) of information for a local attraction 132. Since the information is provided by locals, and is easily updated from one version of the booklet to another, it more readily captures the local's perspective on that attraction, which is a common failing in traditional guide books.

FIG. 13 is another illustration of a booklet in accordance with an embodiment, showing an example page (front) of information for a restaurant 136.

FIG. 14 is another illustration of a booklet in accordance with an embodiment, showing an example page (back) of information for a restaurant 140. As with the attraction destinations, a reader can order items from a menu by reading, in this instance the English version of the food item, and then handing the card to a local-speaking recipient (in this instance Chinese) and pointing to the appropriate entry. This eliminates the need to know the local language for the food item, and also eliminates the need for the reader to try and pronounce a phonetic version of the local word. They can communicate instead by showing or handing out the card and pointing to the appropriate entry.

FIG. 15 is another illustration of a booklet in accordance with an embodiment, showing an example page (front) of information for an entertainment venue 144.

FIG. 16 is another illustration of a booklet in accordance with an embodiment, showing an example page (back) of information for an entertainment venue 146.

Figure 17:
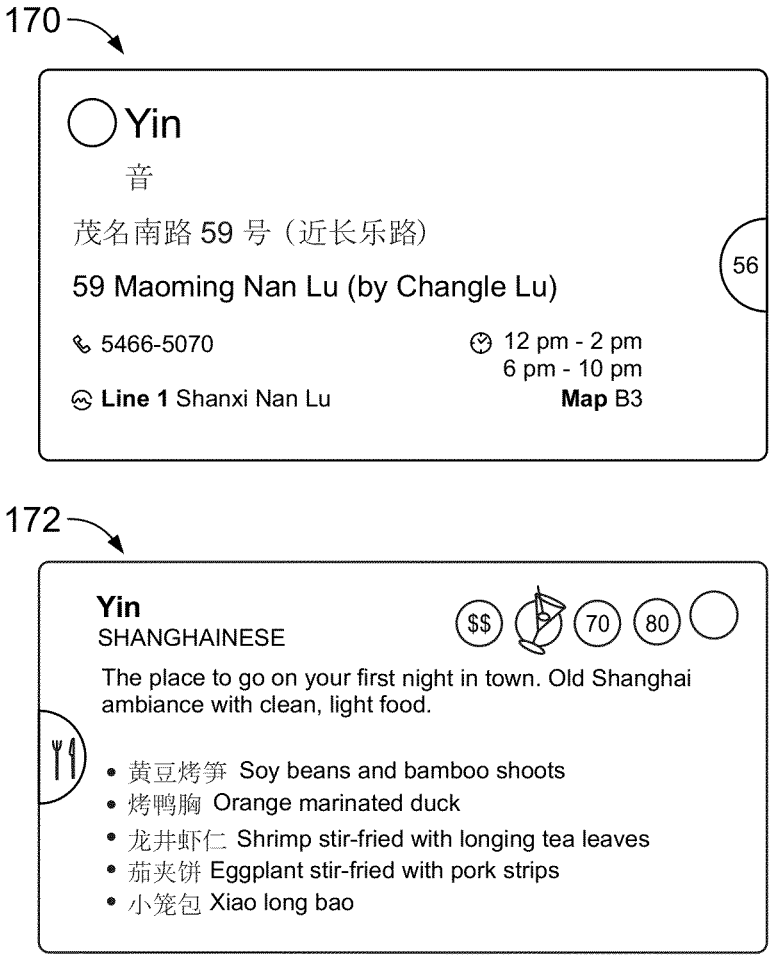
FIG. 17 is another illustration of a booklet in accordance with an embodiment, showing an example page (front and back) of information for a restaurant.

FIG. 17 is another illustration of a booklet in accordance with an embodiment, showing an example page (front 170 and back 172) of information for a restaurant.

Figure 18:
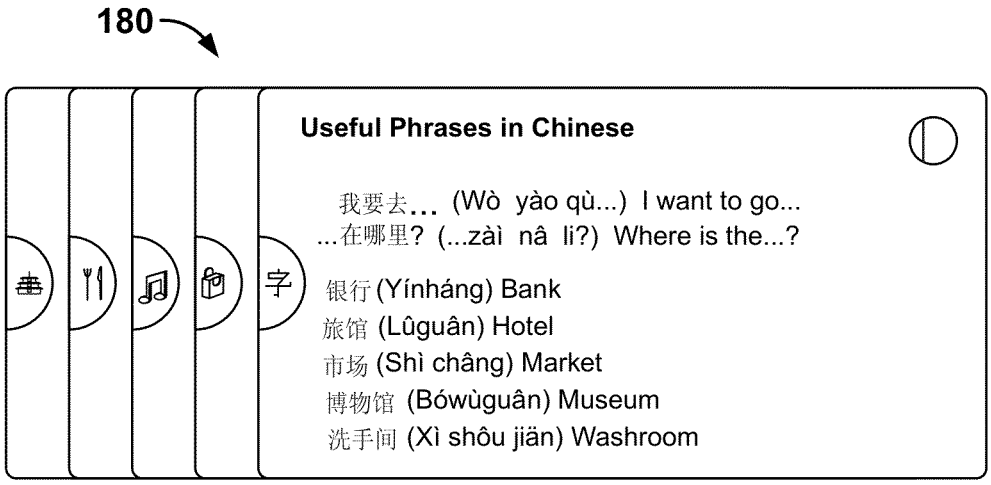
FIG. 18 is an illustration of a booklet in accordance with an embodiment, showing a (front) page of translation information, and also the symbols used for each category.

FIG. 18 is an illustration of a booklet in accordance with an embodiment, showing a (front) page of translation information 180, and also the symbols used for each category.

FIG. 19 is an illustration of a booklet in accordance with an embodiment, showing the reverse page of translation information 182.

FIG. 20 is an illustration of a booklet in accordance with an embodiment, showing a page of food-ordering information 184.

FIG. 21 is an illustration of a booklet in accordance with an embodiment, showing a (front) page of railway information 186. As with the attraction destinations, a reader can locate train stations by handing the card to a taxicab driver, train station operator, or local-speaking recipient and pointing to the appropriate entry.

Figure 22:
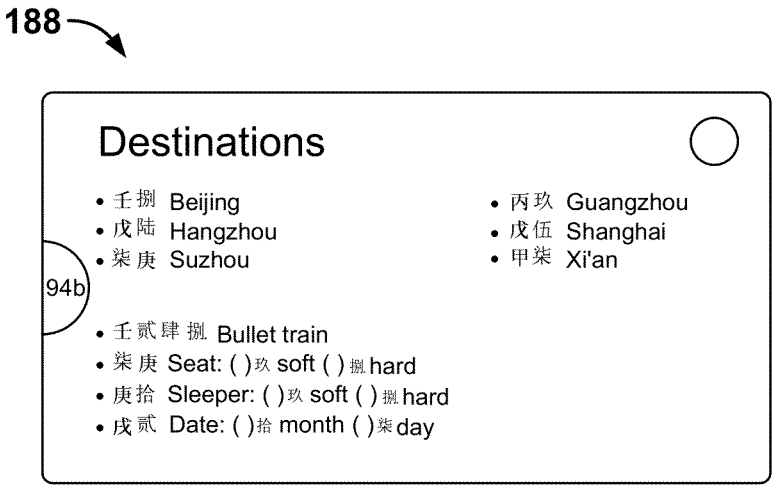
FIG. 22 is an illustration of a booklet in accordance with an embodiment, showing the reverse page of railway information, including destinations (in this instance in English and Chinese).

FIG. 22 is an illustration of a booklet in accordance with an embodiment, showing the reverse page of railway information 188, including destinations (in this instance in English and Chinese). Having located the train station using FIG. 21 above, the reader can then point to appropriate entries on the card to purchase their desired tickets.

Figure 23:
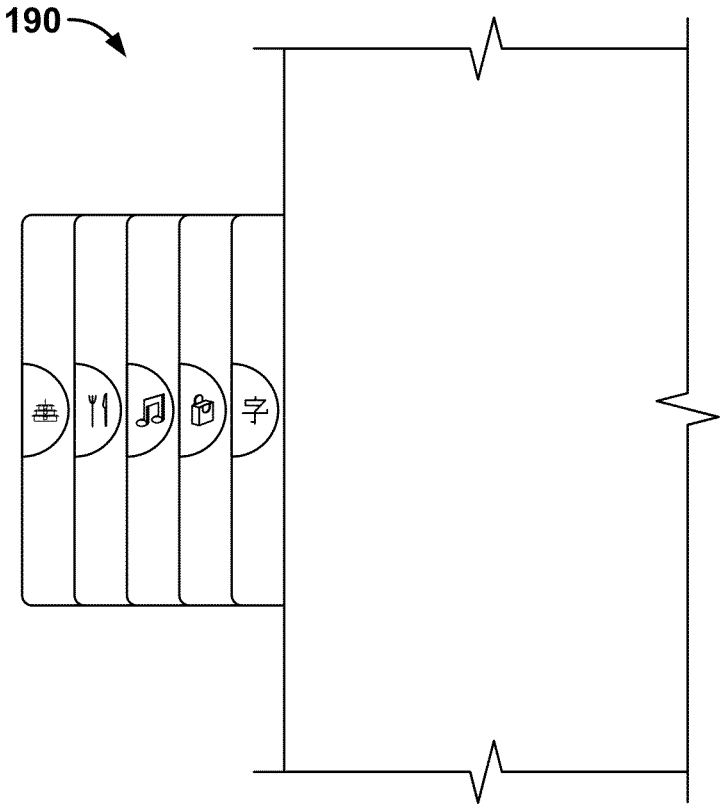
FIG. 23 is an illustration of booklet cards or pages in accordance with an embodiment, showing a variety of page features, including the card/page number, and index pointers to related cards or pages.

FIG. 23 is an illustration of booklet cards or pages in accordance with an embodiment, showing a variety of page features, including the card/page number, and index pointers to related cards or pages. When carried or placed in a wallet, the cards can be fanned out 190 so that the margin symbols are displayed, allowing the reader to quickly locate the cards they need at that particular point in time.

Figure 24:
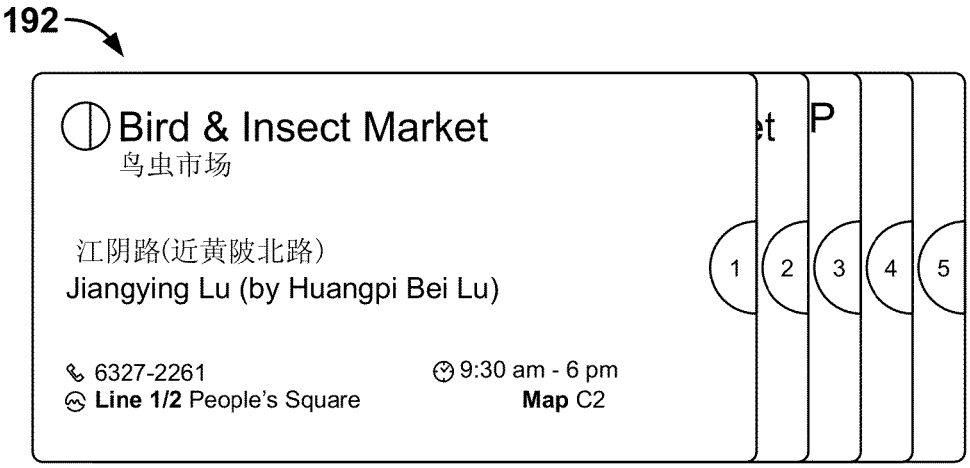
FIG. 24 is an illustration of booklet cards or pages in accordance with an embodiment, showing a variety of page features, including the card/page number, and index pointers to related cards or pages.

FIG. 24 is an illustration of booklet cards or pages in accordance with an embodiment, showing a variety of page features, including the card/page number, and index pointers to related cards or pages.

Figure 25:
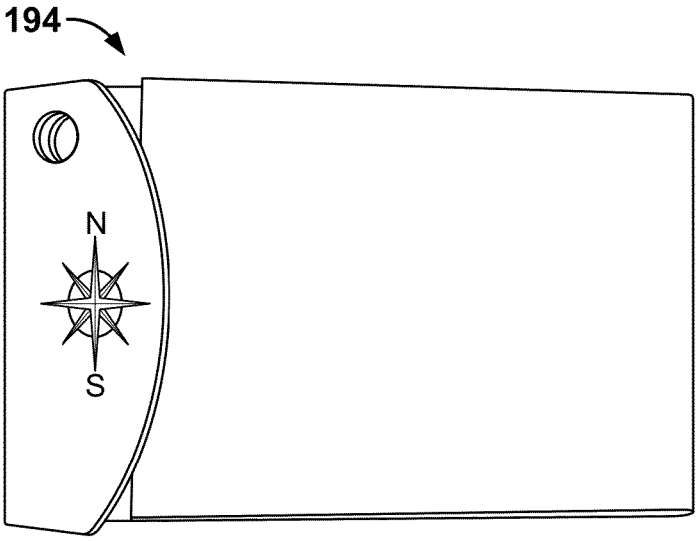
FIG. 25 is an illustration of a booklet in accordance with an embodiment, showing a folded map page.

FIG. 25 is an illustration of a booklet in accordance with an embodiment, showing a folded map page 194. A North-South indicator indicates the orientation of the map.

Figure 26:
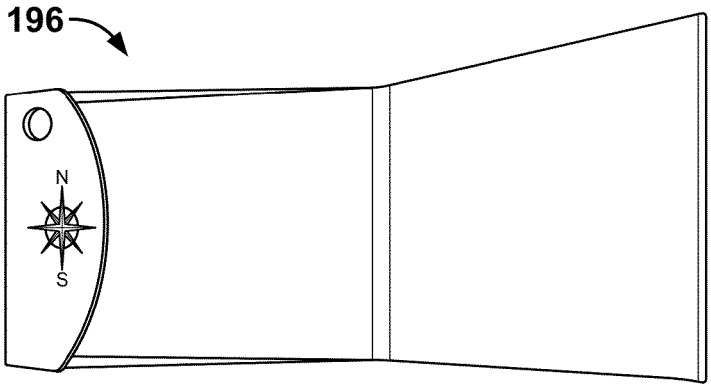
FIG. 26 is an illustration of a booklet in accordance with an embodiment, showing a map page that can be opened.

FIG. 26 is an illustration of a booklet in accordance with an embodiment, showing a map page that can be opened 196.

Figure 27:
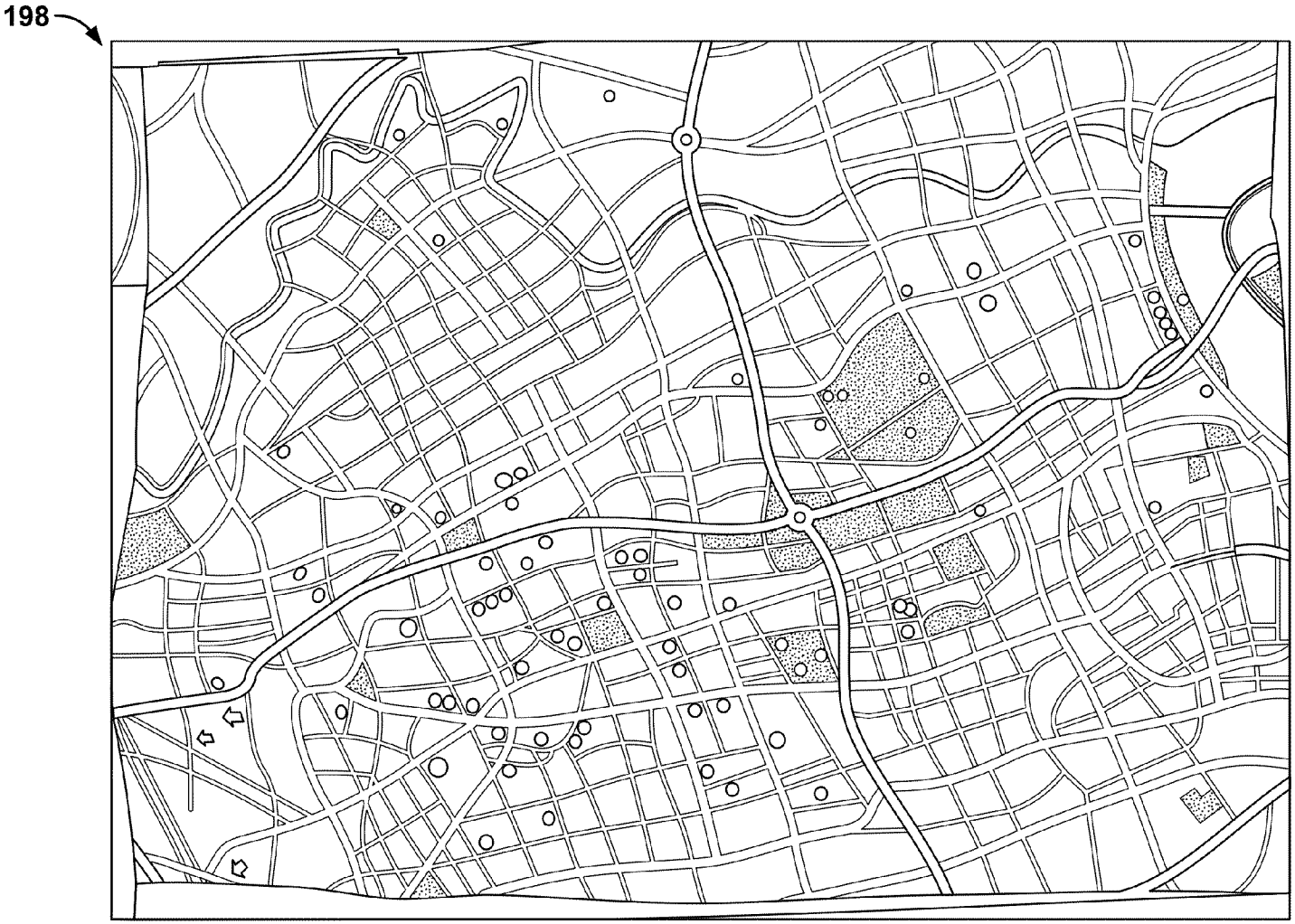
FIG. 27 is an illustration of a booklet in accordance with an embodiment, showing an opened map page.

FIG. 27 is an illustration of a booklet in accordance with an embodiment, showing an opened map page. Each of the cards can be represented on the map using the card number that is unique to each card 198.

Figure 28:
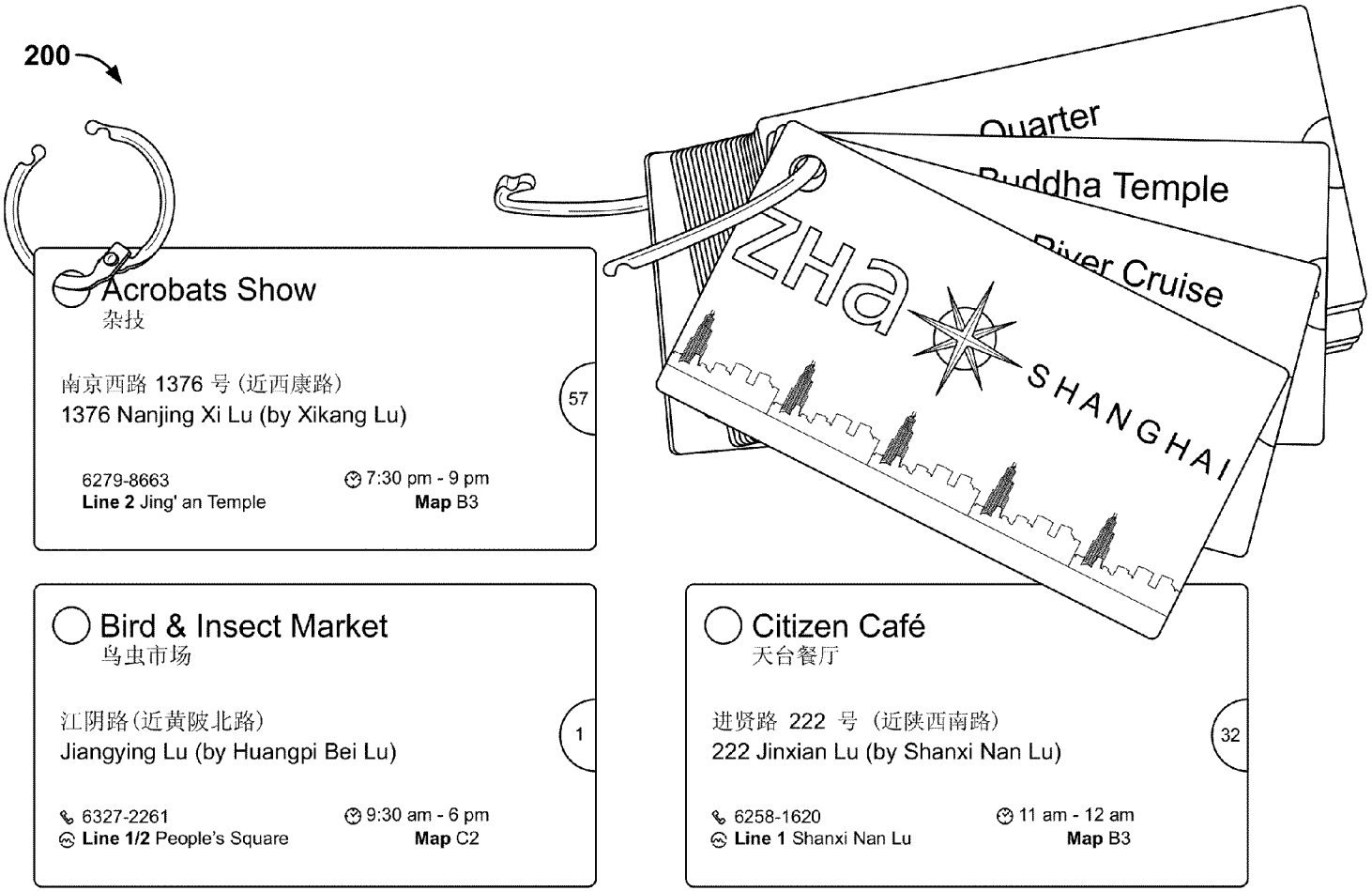
FIG. 28 is an illustration of a booklet with removable cards in accordance with an embodiment, showing how individual cards can be removed from the primary ring fastener.

FIG. 28 is an illustration of a booklet with removable cards in accordance with an embodiment, showing how individual cards can be removed 200 from the primary ring fastener.

FIG. 29 is an illustration of a booklet with removable cards in accordance with an embodiment, showing how individual cards can be used to create a set of cards for a day trip, or an extended trip 210.

Figure 30:
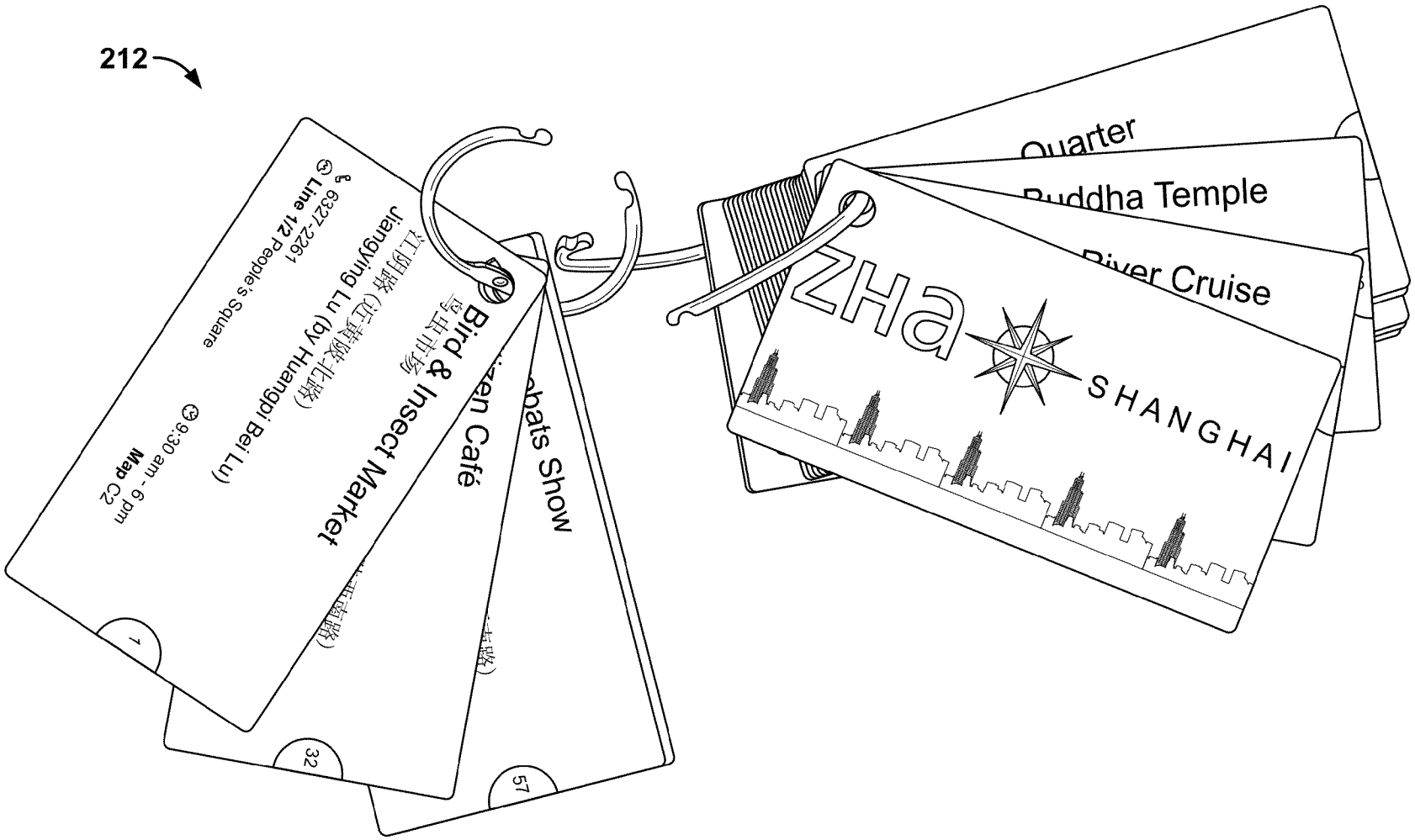
FIG. 30 is an illustration of a booklet with removable cards in accordance with an embodiment, showing how one or more cards that are removed from the primary ring fastener can be added to the secondary ring fastener.

FIG. 30 is an illustration of a booklet with removable cards in accordance with an embodiment, showing how one or more cards that are removed from the primary ring fastener can be added to the secondary ring fastener 212.

Figure 31:
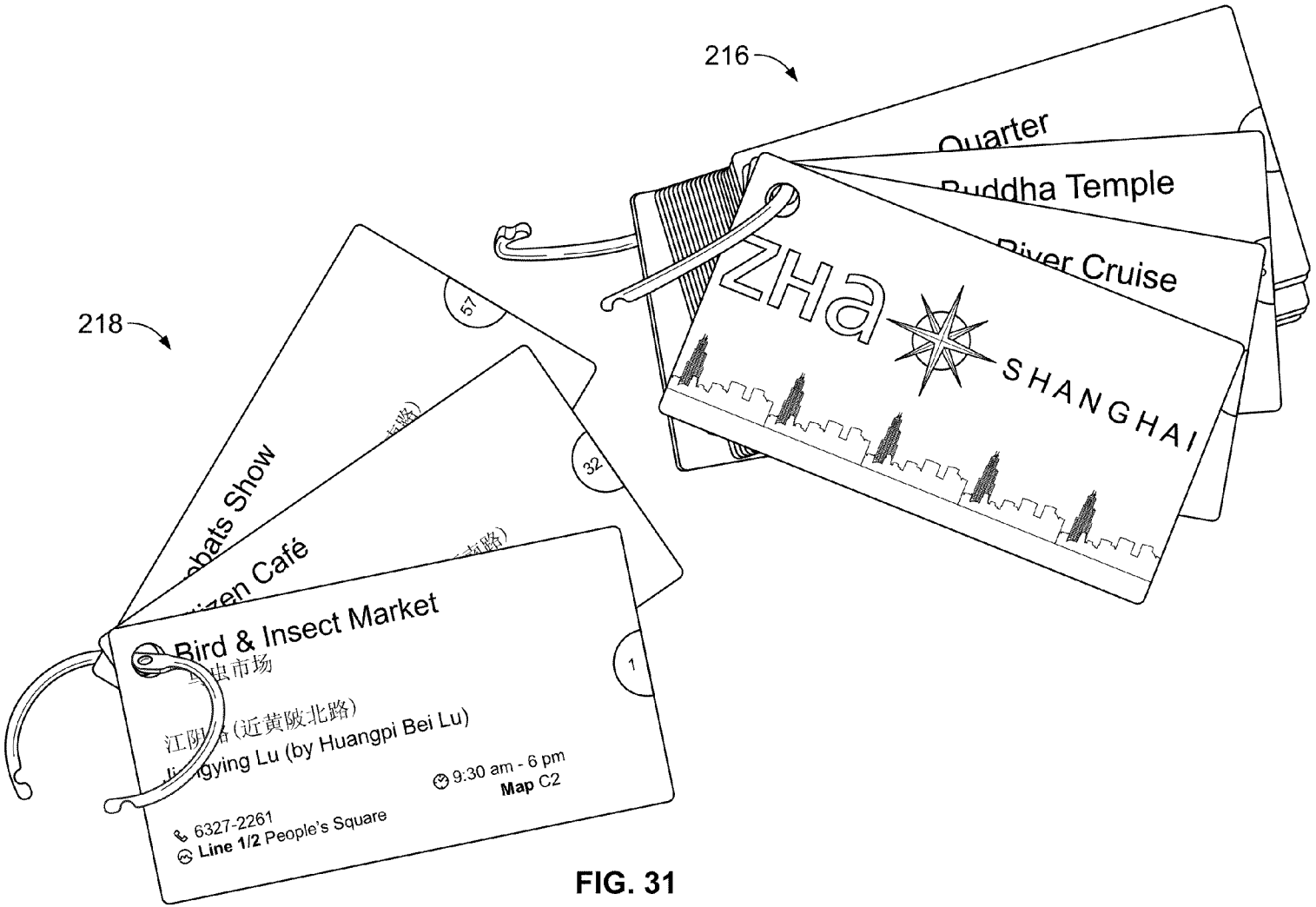
FIG. 31 is an illustration of a booklet in accordance with an embodiment, showing how the ring fasteners can be separated to create two booklets.

FIG. 31 is an illustration of a booklet in accordance with an embodiment, showing how the ring fasteners can be separated to create two booklets 216, 218.

FIG. 32 is an illustration of how individual cards can be used to create a set of cards for a day trip, or an extended trip, wherein the cards can be linked through common symbols and numeric identifiers 220.

Figure 33:
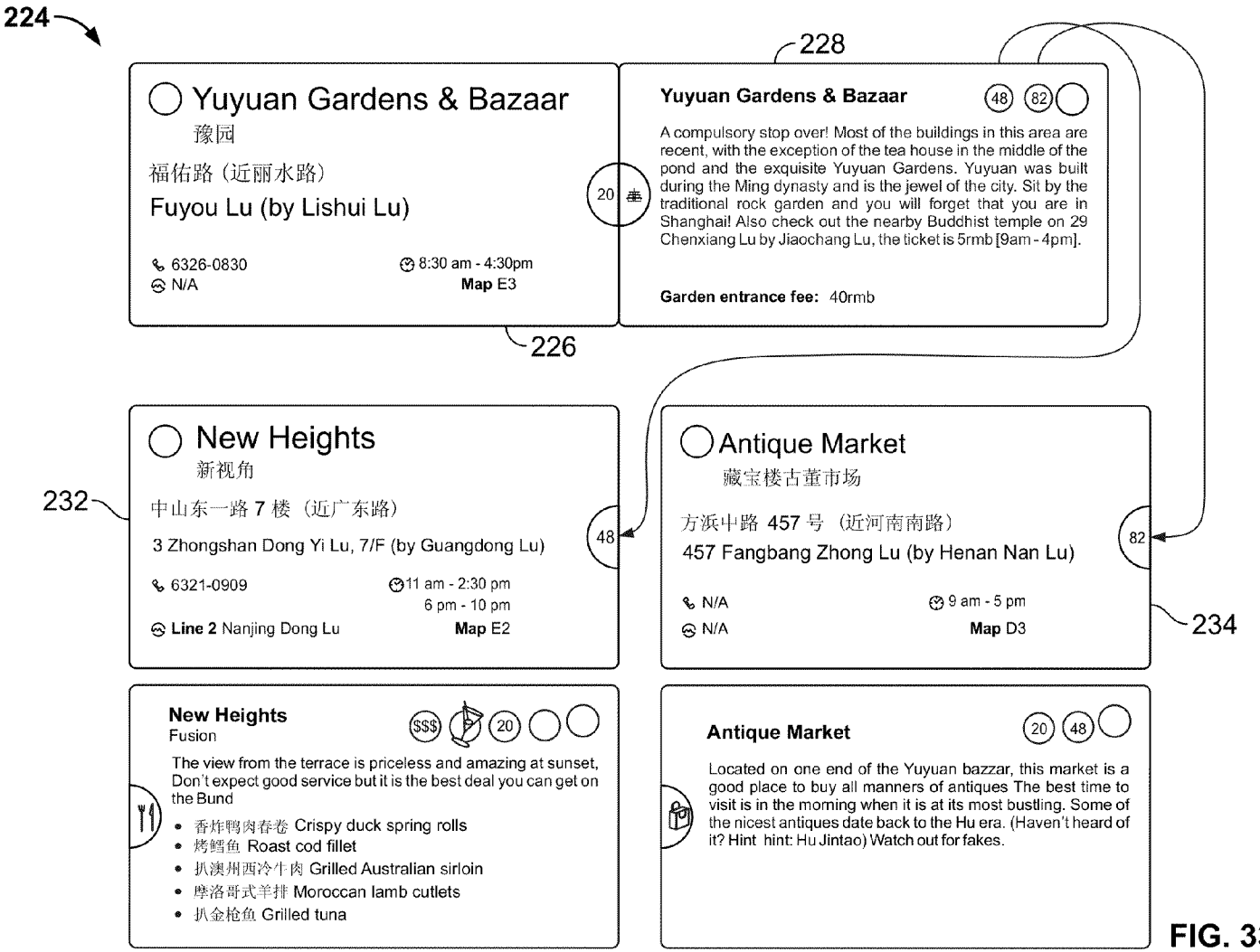
FIG. 33 is an illustration of how the cards can be linked through common symbols and numeric identifiers, including using the identifier numbers on a card to find which cards may be of interest to the reader.

FIG. 33 is an illustration 224 of how the cards can be linked through common symbols and numeric identifiers, including using the identifier numbers on a card to find which cards may be of interest to the reader. That card can then be added to the set of cards if the reader so desires. In this example, the reader has selected card 20 for Yuayuan Gardens & Bazaar (236). The card includes suggestions 238 for nearby attractions including the numbers 48 and 82. If the reader selects cards 48 and 82 (232, 234) they will find them to be New Heights and Antique Market respectively. If the reader desires, then these cards can then be added into their set to create an itinerary for the day. This feature allows the reader to browse through the set of cards, locate a first card they are interested in, and then add or link to additional cards, that they know are in a general proximity of the first card, or share a related attribute. In this way the reader can quickly compose an itinerary of as many cards as they feel they want to accomplish that day.

FIG. 34 is an illustration of a booklet in accordance with an embodiment, showing how the ring fasteners can be separated to create two booklets (shown here side-by-side), including a primary booklet 240 and a secondary booklet 242. In those embodiments that use multiple rings or fasteners, then multiple books can be created.

Figure 35:
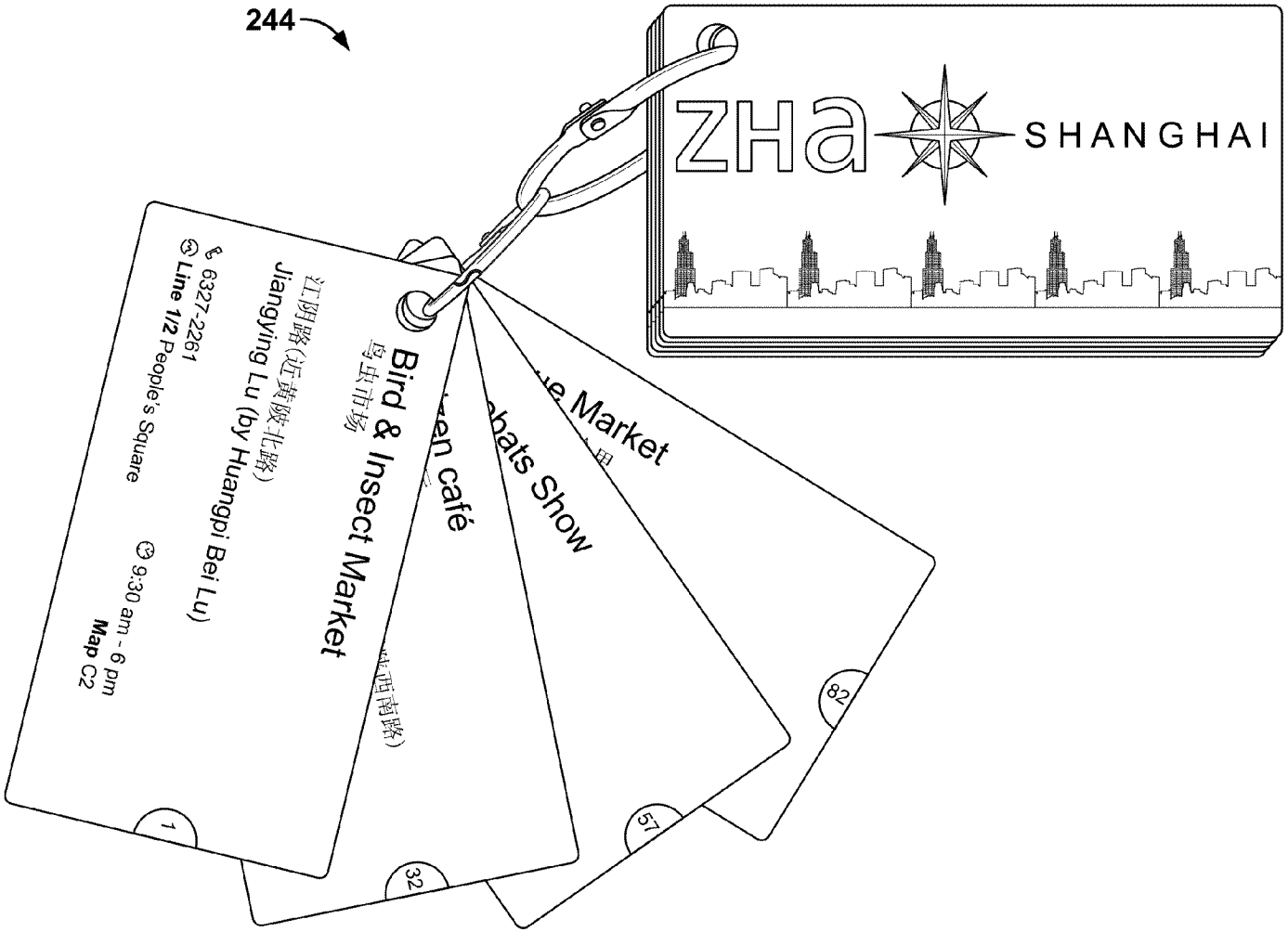
FIG. 35 is an illustration of a booklet with removable cards in accordance with an embodiment, showing how the rings or fasteners can be connected to crate two sets of cards (a complete set, minus the day set) for easy reference to the day set during the day.

FIG. 35 is an illustration of a booklet with removable cards in accordance with an embodiment, showing how the rings or fasteners can be connected to crate two sets of cards (a complete set, minus the day set) for easy reference to the day set during the day 244.

Figure 36:
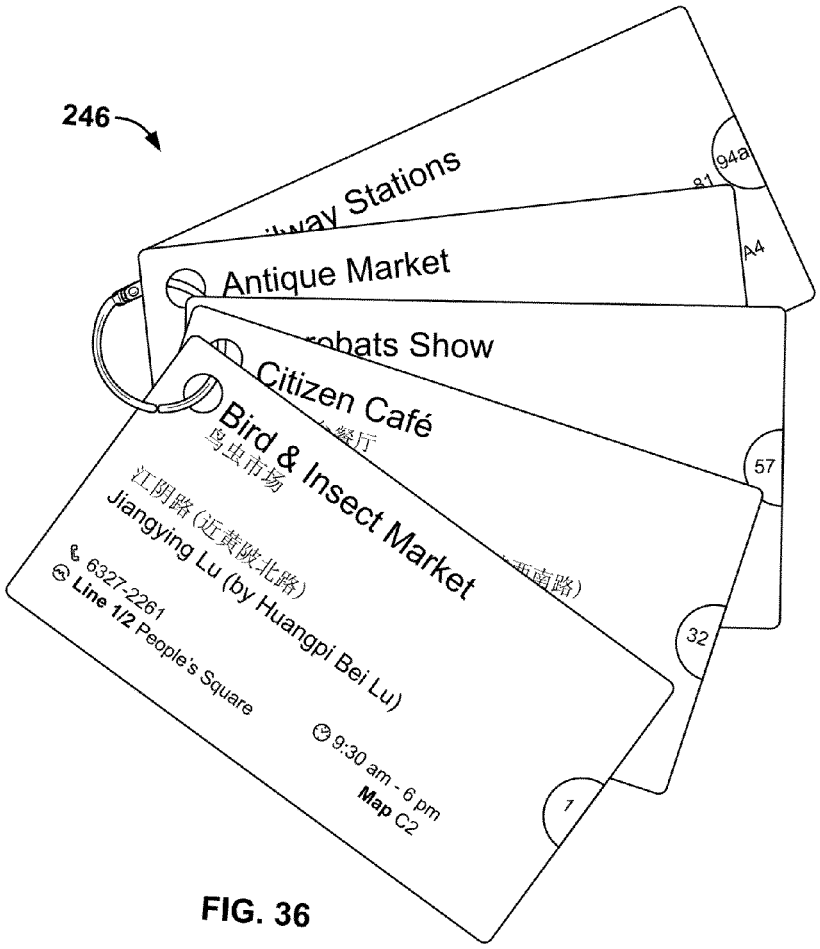
FIG. 36 is an illustration of a booklet with removable cards in accordance with an embodiment, showing how cards that were removed from the primary ring fastener and added to the secondary ring fastener can be carried separately.

FIG. 36 is an illustration of a booklet with removable cards in accordance with an embodiment, showing how cards that were removed from the primary ring fastener and added to the secondary ring fastener can be carried separately 246. (The cards can subsequently be inserted back into the primary ring fastener to consolidate the booklet again).

Figure 37:
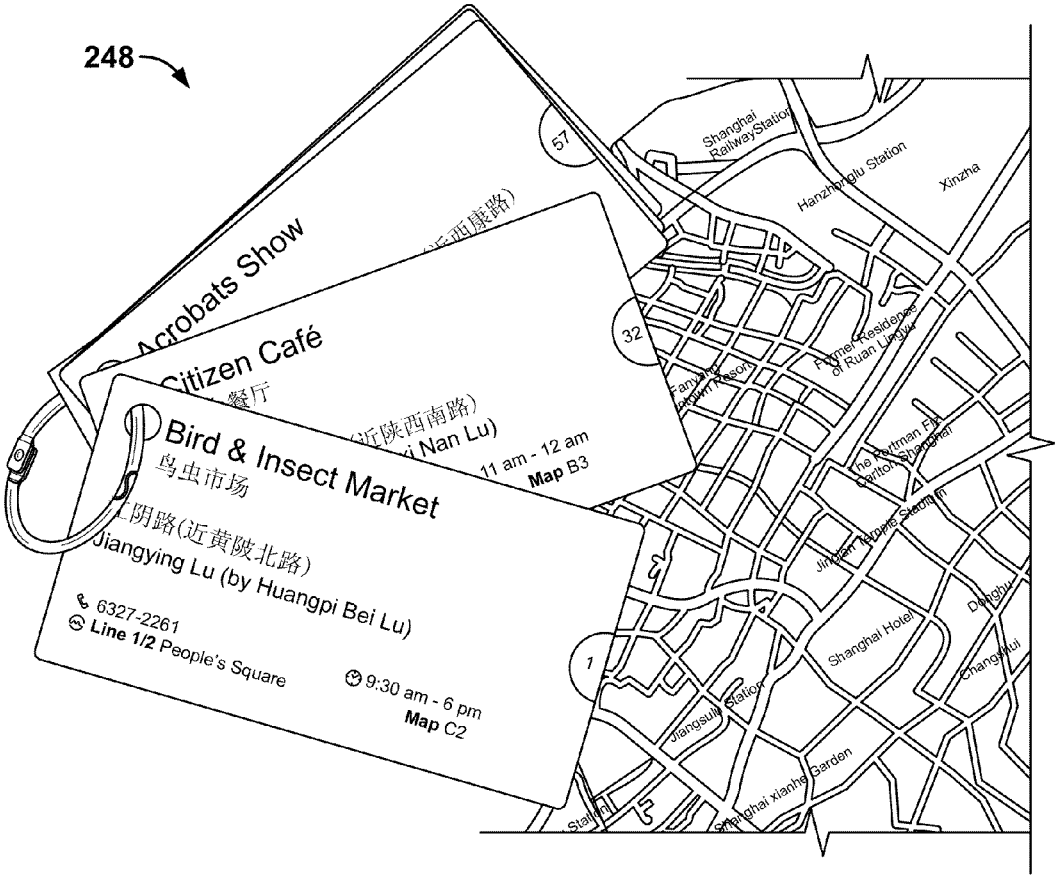
FIG. 37 is an illustration of a booklet in accordance with an embodiment, showing how the secondary booklet can include a fold-out map.

FIG. 37 is an illustration of a booklet 248 in accordance with an embodiment, showing how the secondary booklet can include a fold-out map.

Figure 38:
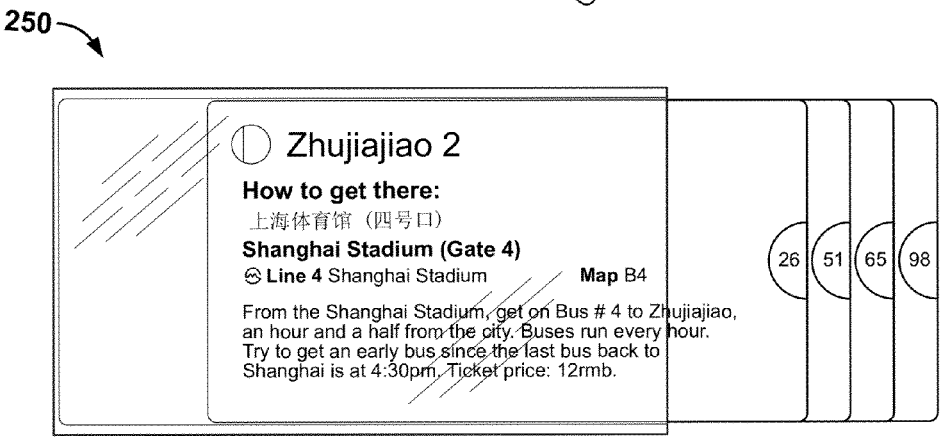
FIG. 38 is an illustration of a booklet with removable cards in accordance with an embodiment, showing how cards can be packaged and/or carried in a pouch, holder, or wallet, instead of a secondary ring or fastener.

FIG. 38 is an illustration of a booklet with removable cards in accordance with an embodiment, showing how cards can be packaged and/or carried in a pouch, holder, or wallet 250, instead of a secondary ring or fastener. The clear plastic wallet assists in showing, e.g. a taxicab driver or a local which of the cards and which entry the reader is interested in, without having to remove the card from the wallet.

Figure 39:
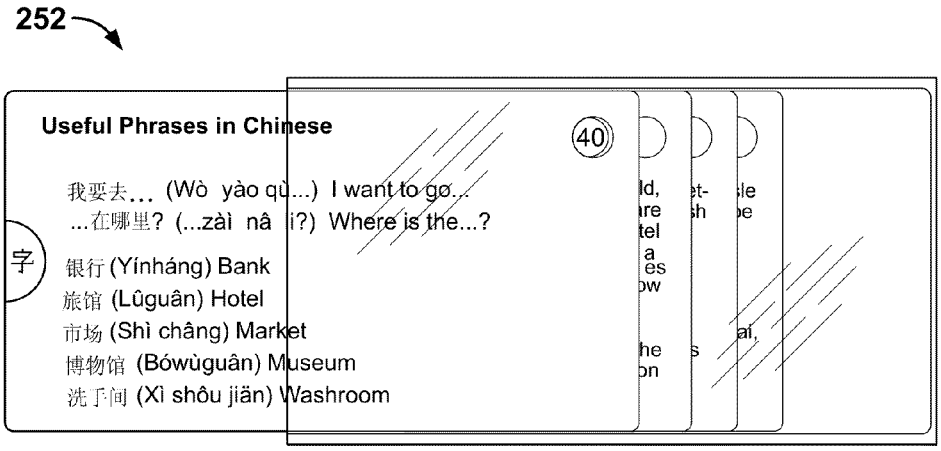
FIG. 39 is another illustration of a booklet with removable cards in accordance with an embodiment, showing how cards can be packaged and/or carried in a pouch, holder, or wallet, instead of a secondary ring or fastener.

FIG. 39 is another illustration of a booklet with removable cards in accordance with an embodiment, showing how cards can be packaged and/or carried in a pouch, holder, or wallet 252, instead of a secondary ring or fastener.

Figure 40:
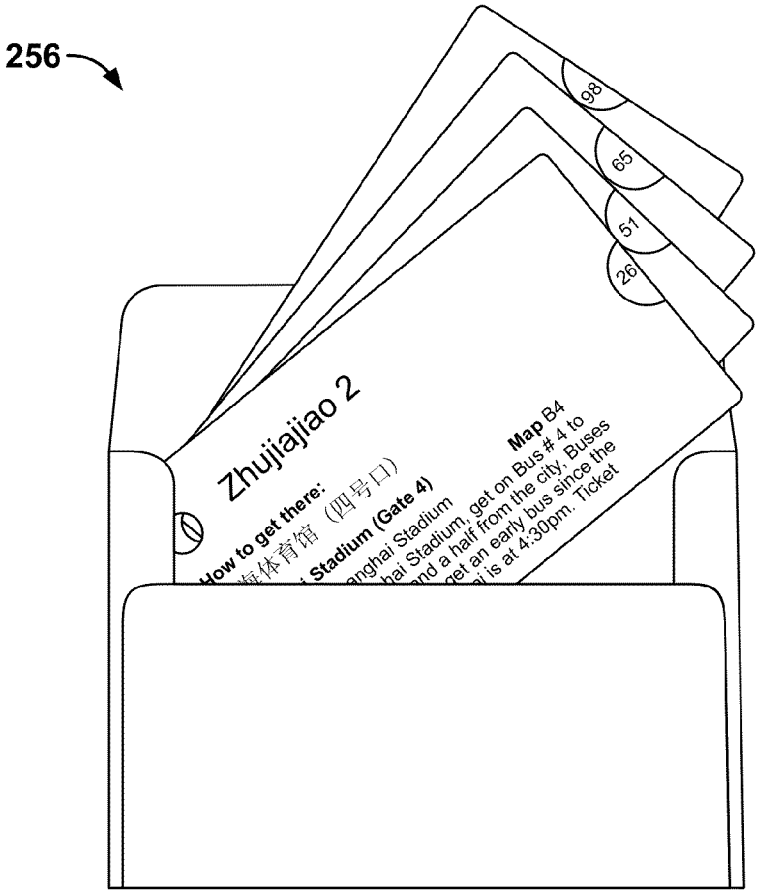
FIG. 40 is another illustration of a booklet with removable cards in accordance with an embodiment, showing how cards can be packaged and/or carried in a pouch, holder, or wallet, instead of a secondary ring or fastener.

FIG. 40 is another illustration of a booklet with removable cards in accordance with an embodiment, showing how cards can be packaged and/or carried in a pouch, holder, or wallet 256, instead of a secondary ring or fastener.

Figure 41:
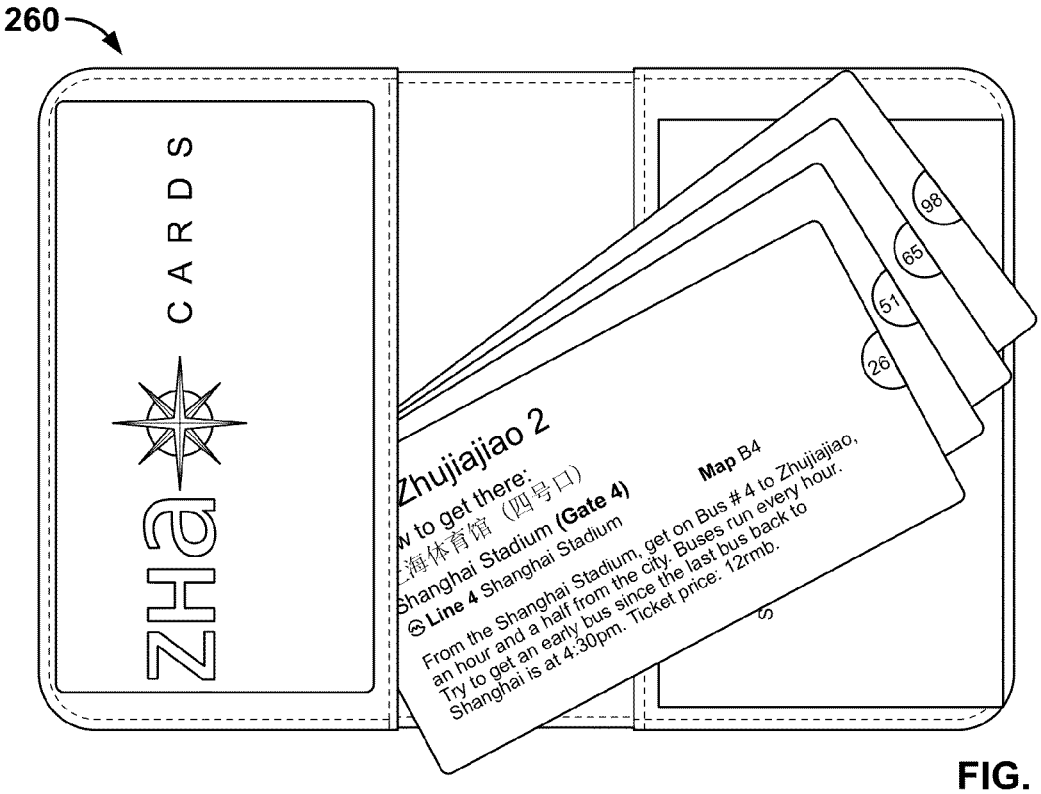
FIG. 41 is another illustration of a booklet with removable cards in accordance with an embodiment, showing how cards can be packaged and/or carried in a pouch, holder, or wallet, instead of a secondary ring or fastener.

FIG. 41 is another illustration of a booklet with removable cards in accordance with an embodiment, showing how cards can be packaged and/or carried in a pouch, holder, or wallet 260, instead of a secondary ring or fastener.

Figure 42:
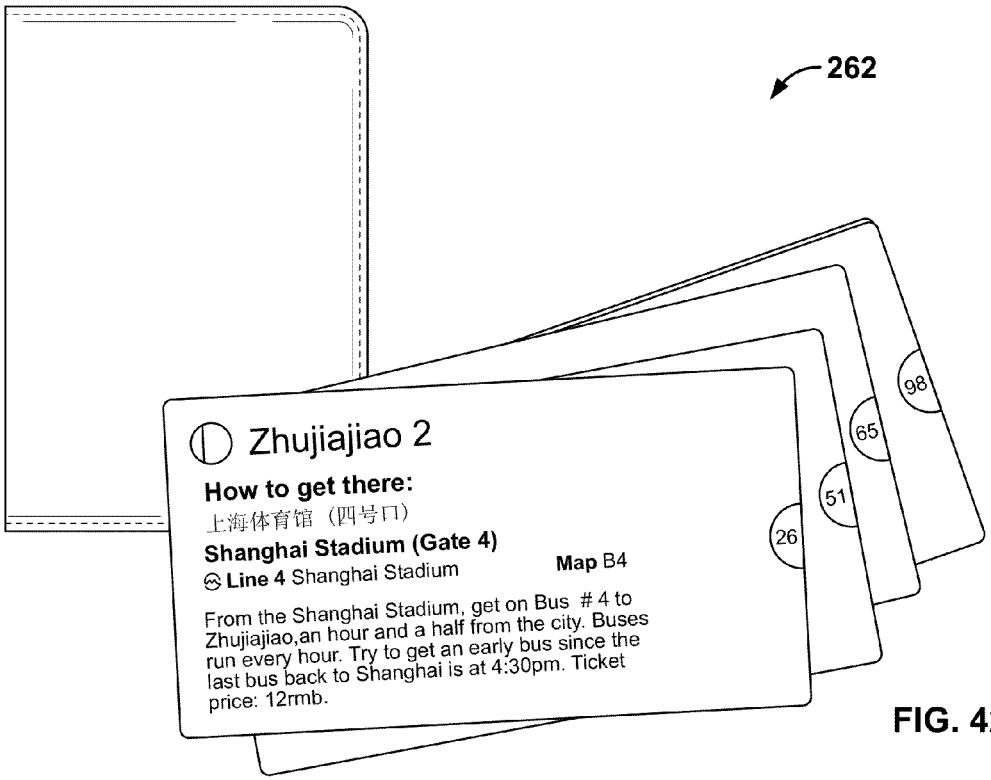
FIG. 42 is another illustration of a booklet with removable cards in accordance with an embodiment, showing how cards can be packaged and/or carried in a pouch, holder, or wallet, instead of a secondary ring or fastener.

FIG. 42 is another illustration of a booklet with removable cards in accordance with an embodiment, showing how cards can be packaged and/or carried in a pouch, holder, or wallet 262, instead of a secondary ring or fastener.

Figure 43:
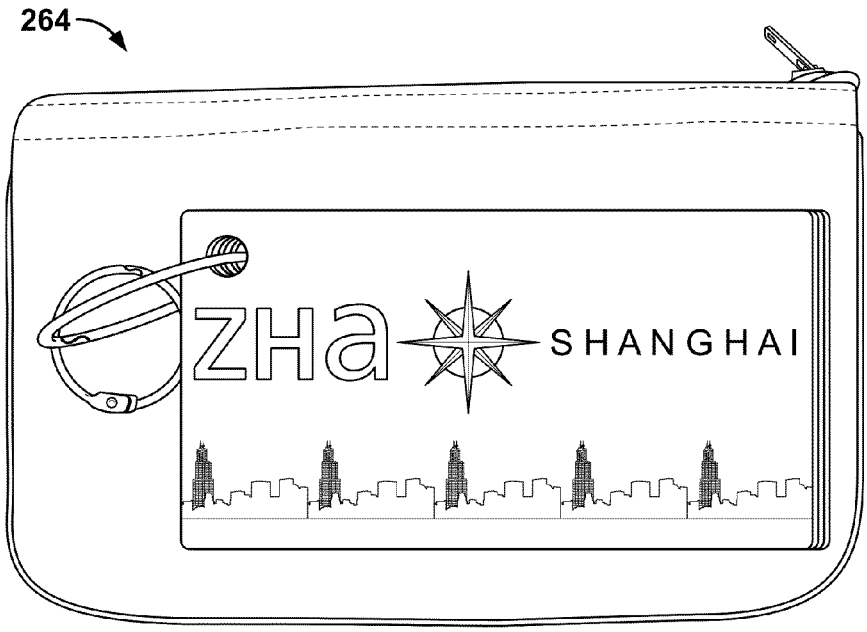
FIG. 43 is an illustration of a booklet with removable cards in accordance with an embodiment, showing how the entire booklet (or several booklets) can be packaged and/or carried in a pouch, holder, or wallet.

FIG. 43 is an illustration of a booklet with removable cards in accordance with an embodiment, showing how the entire booklet (or several booklets) can be packaged and/or carried in a pouch, holder, or wallet 264.

The foregoing description of the present invention has been provided for the purposes of illustration and description. It is not intended to be exhaustive or to limit the invention to the precise forms disclosed. Many modifications and variations will be apparent to the practitioner skilled in the art. Particularly, while the various embodiments described above are described in the context of an English-to-Chinese language guide, it will be evident that the booklet and cards can be similarly developed or modified to suit any of the reader's own languages or reader's language of choice (for example, English, French, German), and the language of the destination country, region, or city (for example, Spanish, Japanese, Russian or another destination language), so that any number of different guides can be developed (for example, English-Spanish; or English-Russian). It will also be evident that cards can be developed to provide a plurality of different languages (for example, English-French-German on each card), and that the coloring, shading and symbol features can be changed to suit particular embodiments. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A booklet with removable cards as pages, comprising:

a first fastener, wallet, or carrying means, that can hold a plurality of cards to act as a booklet, and that can be opened by a reader, so that a selection of one or more cards can be removed;

a second fastener, wallet, or carrying means which can be used to carry the selection of one or more cards that are removed;

wherein each of the plurality of cards includes information printed thereon in two or more languages for use by the reader, a card number marked on its front face that uniquely identifies that card within the plurality of cards, and two or more numbers marked on its back face that identify card numbers of other cards within the plurality of cards, wherein each of the other cards includes related information and also includes on its back face card numbers of those cards which link to that other card; and wherein the reader can select a particular card from the plurality of cards, and use the one or more numbers marked thereon to locate those other cards within the plurality of cards, to form an itinerary or other abbreviated set of related information that can be carried by the second fastener, wallet, or carrying means.

2. The booklet of claim 1 wherein at least one of the first fastener, wallet, or carrying means and the second fastener, wallet, or carrying means are ring fasteners.

3. The booklet of claim 1 wherein at least one of the first fastener, wallet, or carrying means and the second fastener, wallet, or carrying means is a wallet.

4. The booklet of claim 1 wherein the booklet includes a map, catalogs, travel guides, schedule, or other printed information.

5. The booklet of claim 1 wherein the booklet is a travel guide, and wherein each card describes a travel-related attraction and has a unique card number associated therewith in the booklet, and wherein at least one or more of the plurality of cards includes suggestions for nearby attractions and includes identifier symbols or the one or more numbers of those cards associated with those nearby attractions, and wherein the reader can select a first card, and use the suggestions thereon to find one or more additional related cards corresponding to additional attractions to create a travel itinerary.

6. The booklet of claim 1 wherein at least some of the plurality of cards includes, within its set of information printed thereon, information printed in at least two or more different languages.

7. The booklet of claim 6 wherein, when the card is associated with a travel-related attraction, the information printed therein includes how to get to the travel-related attraction, in the two or more different languages.

8. The booklet of claim 1 wherein at least some of the plurality of cards further includes, in addition to the card number marked thereon that uniquely identifies that card, one or more activity symbols representing activities for a region, including one or more of sightseeing, food, entertainment and shopping.

9. The booklet of claim 8 wherein each of the cards includes along its margin its one or more activity symbols.

10. The booklet of claim 1 wherein both the first fastener, wallet, or carrying means and the second fastener, wallet, or carrying means are ring fasteners, and wherein the ring fasteners can be connected to provide two sets of cards for use by the reader, including a first set that contains those cards that form the itinerary or other abbreviated set of related information, and a second set that contains remaining cards within the plurality of cards.

11. A guide book, comprising:

a plurality of information cards, wherein at least some of the information cards provides information about a travel destination, language translation, cultural pointers, or other information;

a first fastener that can hold the plurality of information cards to form a book, and that can be opened by a reader so that one or more information cards can be removed from the book;

a second fastener or carrying means, onto which information cards that are removed from the first fastener can be placed and carried separately, distinct from the book;

wherein each of the plurality of information cards includes information printed thereon in two or more languages for use by the reader, a card number marked on its front face that uniquely identifies that card within the plurality of cards, and two or more numbers marked its back face that identify card numbers of other cards within the plurality of cards, wherein each of the other cards includes related information and also includes on its back face card numbers of those cards which link to that other card; and wherein the reader can select a particular card from the plurality of information cards, and use the one or more numbers marked thereon to locate those other information cards within the plurality of information cards to form an itinerary that can be carried by the second fastener or carrying means.

12. The guide book of claim 11 wherein at least one of the first fastener and the second fastener or carrying means are ring fasteners.

13. The guide book of claim 11 wherein the first fastener is a ring fastener, and the second fastener or carrying means is a wallet.

14. The guide book of claim 11 wherein the book includes a map, catalogs, travel guides, schedule, or other printed information.

15. The guide book of claim 11 wherein each information card describes a travel-related attraction and has a unique card number associated therewith in the guide book, and wherein at least one or more of the plurality of cards includes suggestions for nearby attractions and includes the numbers of those cards associated with those nearby attractions, and wherein the reader can select a first card, and use the suggestions thereon to find one or more additional related cards corresponding to additional attractions to create a travel itinerary.

16. The guide book of claim 11 wherein at least some of the plurality of information cards includes, within its set of information printed thereon, information printed in at least two or more different languages.

17. The guide book of claim 16 wherein, when the information card is associated with a travel-related attraction, the information printed therein includes how to get to the travel-related attraction, in the two or more different languages.

18. A guide book, comprising:

a plurality of information cards that provide information about a travel destination, language translation, cultural pointers, or other information, wherein each information card has a hole punched therein to receive a ring fastener;

a first ring fastener that holds the plurality of information cards to form a main book, and that can be opened by a reader so that two or more of the information cards can be removed from the main book; and a second ring fastener, onto which information cards that are removed from the first fastener can be placed and carried separately as a second book, distinct from the main book; and wherein each of the plurality of information cards includes information printed thereon in two or more languages for use by the reader, a card number marked on its front face that uniquely identifies that card within the plurality of cards, and one or more numbers marked on its back face that identify card numbers of other cards within the plurality of cards, wherein each of the other cards includes related information and also includes on its back face card numbers of those cards which link to that other card, and wherein the reader can select a particular card from the plurality of information cards, and use the one or more numbers marked thereon to locate those other information cards within the plurality of information cards to form an itinerary that can be carried by the second ring fastener.

19. The guide book of claim 18 wherein at least some of the plurality of information cards includes, within its set of information printed thereon, information printed in at least two or more different languages.

20. The guide book of claim 19 wherein, when the information card is associated with a travel-related attraction, the information printed therein includes how to get to the travel-related attraction, in the two or more different languages.

* * * * *